US010380941B2

(12) United States Patent
Song

(10) Patent No.: US 10,380,941 B2
(45) Date of Patent: Aug. 13, 2019

(54) OLED PIXEL CIRCUIT AND DISPLAY DEVICE THEREOF

(71) Applicant: BOE TECHNOLOGY GROUP CO., LTD., Beijing (CN)

(72) Inventor: Chen Song, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 153 days.

(21) Appl. No.: 15/543,280

(22) PCT Filed: Mar. 29, 2016

(86) PCT No.: PCT/CN2016/077634
§ 371 (c)(1),
(2) Date: Jul. 13, 2017

(87) PCT Pub. No.: WO2016/202037
PCT Pub. Date: Dec. 22, 2016

(65) Prior Publication Data

US 2018/0005571 A1 Jan. 4, 2018

(30) Foreign Application Priority Data

Jun. 15, 2015 (CN) ..... 2015 1 0329894

(51) Int. Cl.
*G09G 3/3233* (2016.01)
*G09G 3/3208* (2016.01)
*G09G 3/32* (2016.01)

(52) U.S. Cl.
CPC ..... *G09G 3/3233* (2013.01); *G09G 3/32* (2013.01); *G09G 3/3208* (2013.01);
(Continued)

(58) Field of Classification Search
CPC ..... G09G 3/3233; G09G 3/32; G09G 2300/0842; G09G 2310/0251;
(Continued)

(56) References Cited

U.S. PATENT DOCUMENTS 5,949,194 A 9/1999 Kawakami et al.
7,061,452 B2 6/2006 Inoue et al.
(Continued)

FOREIGN PATENT DOCUMENTS

CA 1922470 A 2/2007
CA 101048809 A 10/2007
(Continued)

OTHER PUBLICATIONS

First Office Action for Chinese Patent Application No. 201510329894.3 dated Dec. 30, 2016.
(Continued)

*Primary Examiner* — Julie Anne Watko
(74) *Attorney, Agent, or Firm* — Calfee, Halter & Griswold LLP

(57) ABSTRACT

An OLED pixel circuit and a display apparatus comprising the OLED pixel circuit. An OLED pixel circuit comprises an OLED and driving units (TFT1, S1, C) for driving the OLED to emit light, wherein one electrode of the OLED is connected to the driving units (TFT1, S1, C). The OLED pixel circuit further comprises compensation units (R1, S2, TFT2, R2). The compensation units (R1, S2, TFT2, R2) comprises a sensing element (R1) which can sense light and convert an optical signal of the OLED into an electrical signal. The compensation units (R1, S2, TFT2, R2) compensate for currents used by the driving units (TFT1, S1, C) to drive the OLED according to the light-emitting brightness of the OLED.

18 Claims, 8 Drawing Sheets

(52) U.S. Cl.
CPC ..... *G09G 2300/0842* (2013.01); *G09G 2310/0251* (2013.01); *G09G 2310/0262* (2013.01); *G09G 2320/0233* (2013.01); *G09G 2320/043* (2013.01); *G09G 2320/045* (2013.01); *G09G 2360/145* (2013.01)

(58) Field of Classification Search
CPC ... G09G 2310/0262; G09G 2320/0233; G09G 2320/043; G09G 2320/045; G09G 2330/021; G09G 2360/145; G09G 3/3208
See application file for complete search history.

(56) References Cited

U.S. PATENT DOCUMENTS

| | | | | |
|---|---|---|---|---|
| 9,214,107 | B2 | 12/2015 | Fish et al. | |
| 2003/0142047 | A1 | 7/2003 | Inoue et al. | |
| 2006/0256048 | A1 | 11/2006 | Fish et al. | |
| 2009/0128534 | A1 | 5/2009 | Fish et al. | |
| 2014/0362060 | A1 | 12/2014 | Tanikame | |
| 2016/0163260 | A1* | 6/2016 | Takahashi | G09G 3/3233 345/207 |

FOREIGN PATENT DOCUMENTS

| | | | | | |
|---|---|---|---|---|---|
| CA | 101276529 | A | | 10/2008 | |
| CA | 103137072 | A | | 6/2013 | |
| CN | 1459088 | A | * | 11/2003 | G09G 3/3233 |
| CN | 1459088 | A | | 11/2003 | |
| CN | 1846243 | A | | 10/2006 | |
| CN | 101014991 | A | * | 8/2007 | G06F 3/03542 |
| CN | 101014991 | A | | 8/2007 | |
| CN | 103927988 | A | | 7/2014 | |
| CN | 104900186 | A | | 9/2015 | |
| EP | 0923067 | A1 | | 6/1999 | |
| EP | 1665207 | A2 | | 6/2006 | |
| EP | 1807820 | A2 | | 7/2007 | |
| EP | 2975605 | A1 | | 1/2016 | |
| JP | H09305145 | A | | 11/1997 | |
| JP | 2006251632 | A | | 9/2006 | |
| WO | 2005022498 | A2 | | 3/2005 | |
| WO | 2005022498 | A3 | | 3/2005 | |
| WO | 2006046196 | A2 | | 5/2006 | |
| WO | 2006046196 | A3 | | 5/2006 | |

OTHER PUBLICATIONS

Notification of Grant for Chinese Patent Application No. 201510329894.3 dated May 2, 2017.
Search Report for International Patent Application No. PCT/CN2016/077634 dated Jun. 27, 2016.

* cited by examiner

OLED PIXEL CIRCUIT AND DISPLAY DEVICE THEREOF

CROSS-REFERENCE TO RELATED APPLICATIONS

This application is based upon International Application No. PCT/CN2016/077634, filed on Mar. 29, 2016, which is based upon and claims priority of Chinese Patent Application No. 201510329894.3 filed on Jun. 15, 2015, which is hereby incorporated by reference in its entirety as part of this application.

TECHNICAL FIELD

The present disclosure relates to the field of display technology, and more particularly to an OLED pixel circuit and a display device thereof.

BACKGROUND

In a conventional TFT-OLED pixel circuit, uncontrollable factors of a thin film transistor (TFT) and an organic light emitting diode (OLED) light emitting device, such as process instability, parameter drift, and device aging, results in a change in a current of the OLED, which in turn, results in a uneven light-emitting brightness of a display device including the TFT-OLED pixel circuit.

In order to solve the problem of uneven light-emitting brightness, the conventional compensation method usually detects the voltage/current signals applied to the OLEDs, thereby compensating the voltage/current signals. This compensation method generally solves the problem of uneven light-emitting brightness caused by the change in the characteristics of the driving transistor TFT, but cannot compensate for the problem of uneven light-emitting brightness caused by aging and deterioration of the OLED devices themselves but still occurring when the currents of the OLEDs are made uniform.

SUMMARY

The present disclosure provides an OLED pixel circuit and a display device thereof.

Some embodiments of the present disclosure provide an OLED pixel circuit, including an OLED and a driving unit for driving the OLED to emit light, one electrode of the OLED is coupled to the driving unit, wherein the OLED pixel circuit further includes a compensation unit, the compensation unit includes a sensing element that can sense light and convert an optical signal of the OLED to an electrical signal, and the compensation unit is configured to compensate a current of the driving unit for driving the OLED according to the light-emitting brightness of the OLED.

Some embodiments of the present disclosure also provide a display device, including the OLED pixel circuit described as above.

DETAILED DESCRIPTION

Figure 1:
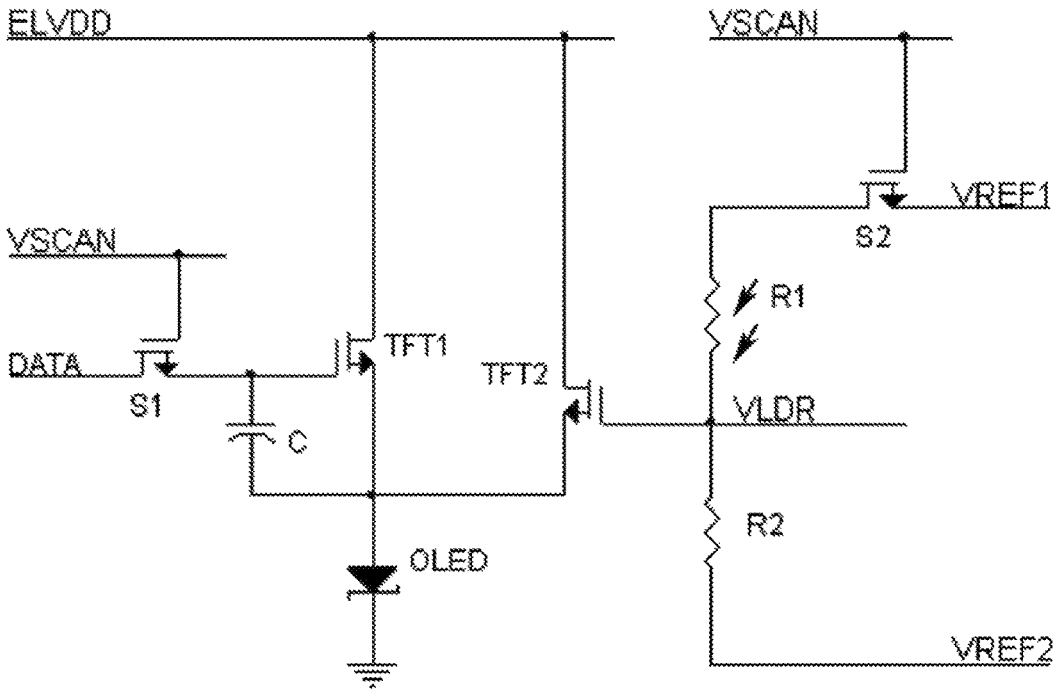
FIGS. 1 and 2 show principle views of an OLED pixel circuit according to a first embodiment of the present disclosure.

The OLED pixel circuit and the display device of the present disclosure will be described in further detail with reference to the accompanying drawings and specific embodiments thereof, in order to provide a better understanding of the technical solution of the present disclosure for those skilled in the art.

In order to solve the problem of uneven light-emitting brightness caused by aging and deterioration of the OLED devices themselves but still occurring when the currents of the OLEDs are made uniform, the present disclosure provides an OLED pixel circuit. The OLED pixel circuit compensates the unevenness of the light-emitting brightness of the OLEDs by utilizing the property that a photosensitive resistor can sense light and can convert an optical signal into an electrical signal.

The OLED pixel circuit includes an OLED and a driving unit for driving the OLED to emit light, and one electrode of the OLED is coupled to the driving unit. The OLED pixel circuit further includes a compensation unit. The compensation unit includes a sensing element that can sense light and can convert an OLED optical signal into an electrical signal. The compensation unit compensates the current of the driving unit for driving the OLED according to the light-emitting brightness of the OLED.

In an embodiment, the sensing element is a photoresistor, and the compensation unit further includes a synchronous transistor, a compensation driving transistor and a voltage divider resistor.

The photoresistor is coupled to the voltage divider resistor in series to form a series branch. A first terminal of the series branch is a constraint terminal and is coupled to the synchronous transistor. A second terminal of the series branch is a free terminal and coupled to a second reference voltage terminal.

A control electrode of the synchronous transistor is coupled to a scan signal terminal. A first electrode of the synchronous transistor is coupled to the constraint terminal of the series branch. A second electrode of the synchronous transistor is coupled to a first reference voltage terminal.

A control electrode of the compensation driving transistor is coupled to a series coupling point of the photoresistor and the voltage divider resistor. A first electrode of the compensation driving transistor is coupled to a first voltage input terminal or a cathode of the OLED. A second electrode of the compensation driving transistor is coupled to an anode of the OLED or a second voltage input terminal.

A first reference voltage at the first reference voltage terminal is larger than a second reference voltage at the second reference voltage terminal, and the second reference voltage is smaller than a turn-on voltage of the OLED.

In order to achieve a better effect for compensating a current, a thin film transistor serving as the compensation driving transistor needs to operate in a linear region. In the present disclosure, the voltage divider resistor is a constant resistor with respect to the photoresistor, and adjusts the divided voltage at the series coupling point in the series branch according to the ratio of the first reference voltage and the second reference voltage, such that the compensation driving transistor in the compensation unit is operated in the linear region. That is, by means of the constant resistance value of the voltage divider resistor and by simultaneously adjusting the reference voltage VREF1 and/or VREF2, the compensation driving transistor is operated in the linear region.

The driving unit compensated by the compensation unit includes an output transistor. The driving unit is coupled to the first voltage input terminal, the second voltage input terminal, the scan signal terminal and a data signal terminal. One electrode of the OLED is coupled to the output transistor, and the other electrode of the OLED is coupled to the first voltage input terminal or the second voltage input terminal.

In addition, depending on a different position of the OLED in the pixel circuit (the cathode thereof is coupled to ground, or the anode thereof is coupled to a high potential terminal), and depending on the driving element used is an N-type thin film transistor or a P-type thin film transistor, the photoresistor is of the positive coefficient property or the negative coefficient property. The present disclosure provides eight OLED pixel circuit configurations.

In FIGS. 1-8 of the description, a photoresistor R1 detects a light-emitting brightness of the OLED. The resistance value of the photoresistor changes as the light-emitting brightness changes, in turn, affecting the voltage at the gate electrode (or voltage at the control electrode) of the compensation driving transistor. The current provided by the compensation driving transistor to the OLED changes as the divided voltage changes, to eventually compensate the driving current of the OLED.

In the following embodiments, the OLED pixel circuit will be described with reference to principle diagrams of various circuits. In various exemplary embodiments, the driving unit is compensated with a positive or negative coefficient photoresistor.

First Embodiment

Figure 2:
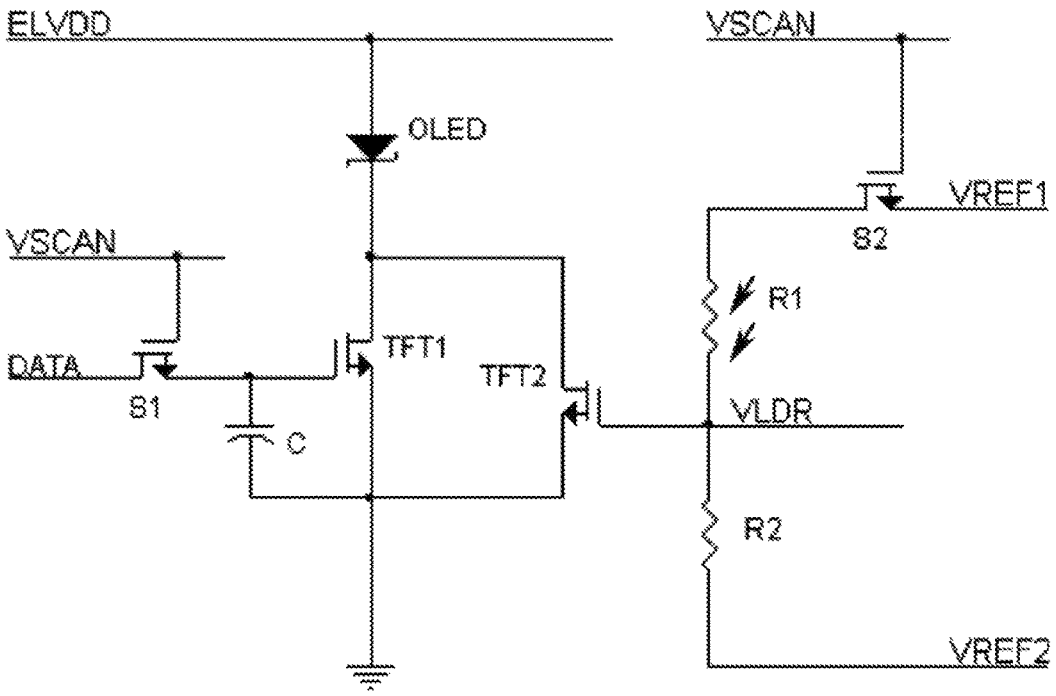

This embodiment provides an OLED pixel circuit, in which a driving unit including an N-type thin film transistor is compensated with a positive coefficient photoresistor. The specific circuit is shown in FIGS. 1 and 2.

In the OLED pixel circuit, the sensing element is a photoresistor R1. In addition to the sensing element (e.g. the photoresistor R1), the compensation unit also includes a synchronous transistor S2, a compensation driving transistor TFT2 and a voltage divider resistor R2.

The photoresistor R1 is coupled to the voltage divider resistor R2 in series to form a series branch. A first terminal of the series branch is a constraint terminal and is coupled to the synchronous transistor S2. A second terminal of the series branch is a free terminal and coupled to a second reference voltage terminal (or having a second reference voltage VREF2). In FIG. 1, one terminal of the photoresistor R1 in the series branch is the constraint terminal and coupled to a first electrode of the synchronous transistor S2, and one terminal of the voltage divider resistor R2 in the series branch is the free terminal and coupled to the second reference voltage terminal.

A control electrode of the synchronous transistor S2 is coupled to a scan signal terminal VSCAN. A first electrode of the synchronous transistor S2 is coupled to the constraint terminal of the series branch. A second electrode of the synchronous transistor S2 is coupled to a first reference voltage terminal (which may have a first reference voltage VREF1).

A control electrode of the compensation driving transistor TFT2 is coupled to a series coupling point of the photoresistor R1 and the voltage divider resistor R2. A first electrode of the compensation driving transistor TFT2 is coupled to a first voltage input terminal (for example, a high potential terminal ELVDD). A second electrode of the compensation driving transistor TFT2 is coupled to an electrode of the OLED (coupled to an anode of the OLED, as shown in FIG. 1).

A first reference voltage VREF1 at the first reference voltage terminal is larger than a second reference voltage VREF2 at the second reference voltage terminal, and the second reference voltage VREF2 is smaller than a turn-on voltage of the OLED.

The OLED pixel circuit as shown in FIG. 1 uses an N-type thin film transistor, and the compensation unit uses the positive coefficient photoresistor R1 to detect the emitted light. That is, in the embodiment, both of the synchronous transistor S2 and the compensation driving transistor TFT2 are N-type thin film transistors. The photoresistor R1 is a positive coefficient photoresistor with a resistance value which increases as the light-emitting brightness of the OLED increases. The free terminal of the series branch is one terminal of the voltage divider resistor R2 which is not coupled to the photoresistor R1. For the positive coefficient photoresistor R1, when there is no light irradiation, its resistance value is very low; and when there is light irradiation, its resistance value increases as the light irradiation increases.

In FIG. 1, the commonly used driving unit of the OLED is taken as an example. The driving unit includes an output transistor TFT1, a gating transistor S1 and a storage capacitor C. The first electrode of the output transistor TFT1 is coupled to the first voltage input terminal (i.e., the high potential terminal ELVDD). The second electrode of the output transistor TFT1 is coupled to the anode of the OLED and a second terminal of the storage capacitor C. The cathode of the OLED is coupled to the second voltage input terminal (i.e., a low potential terminal). A control electrode of the gating transistor S1 is coupled to the scan signal terminal VSCAN. A first electrode of the gating transistor S1 is coupled to a data signal terminal DATA. A second electrode of the gating transistor S1 is respectively coupled to a first terminal of the storage capacitor C and a control electrode of the output transistor TFT1. Here, the first electrode of the compensation driving transistor TFT2 is coupled to the first voltage input terminal, and the second electrode of the compensation driving transistor TFT2 is coupled to the second terminal of the storage capacitor C and the anode of the OLED.

In this embodiment, both of the gating transistor S1 and the output transistor TFT1 in the driving unit use the same type of N-type thin film transistor or P-type thin film transistor as the synchronous transistor S2 and the compensation driving transistor TFT2 in the compensation unit.

In order to simplify the circuit structure, the value of the second reference voltage VREF2 at the second reference voltage terminal is equal to the value of the second input voltage at the second input voltage terminal. In FIG. 1, the first input voltage at the first input voltage terminal is a positive voltage, and the second input voltage at the second input voltage terminal is a ground voltage (that is, the cathode of the OLED is grounded). In this case, the second voltage input terminal and the second reference voltage terminal may be incorporated to the same port, and the port is respectively coupled to the cathode of the OLED and one terminal (i.e. the free terminal) of the voltage divider resistor R2. The first reference voltage VREF1 is higher than the second reference voltage VREF2, and the second reference voltage VREF2 should be lower than the turn-on voltage of the OLED, thereby ensuring that the compensation driving transistor TFT2 does not turn on the OLED when the pixel does not emit light. Generally, the second reference voltage VREF2 may be a ground voltage.

The OLED pixel circuit as shown in FIG. 2 uses an N-type thin film transistor, and the compensation unit uses the positive coefficient photoresistor R1 to detect the emitted light. In the driving unit, the first electrode of the output transistor TFT1 is coupled to the cathode of the OLED (the anode of the OLED is coupled to the high potential terminal ELVDD). The second electrode of the output transistor TFT1 is coupled to the second voltage input terminal (which is a low potential terminal) and the second terminal of the storage capacitor C. Here, the first electrode of the compensation driving transistor TFT2 is coupled to the cathode of the OLED, and the second electrode of the compensation driving transistor TFT2 is coupled to the second terminal of the storage capacitor C and the second voltage input terminal.

The OLED pixel circuit in FIG. 2 has the same operation principle as the OLED pixel circuit in FIG. 1, except in that the electrodes of the OLED is coupled in a different way from that in FIG. 1 (in FIG. 1, the cathode of the OLED is grounded (that is, coupled to the second voltage input terminal), while in FIG. 2, the anode of the OLED is coupled to a high potential terminal and the cathode of the OLED is not directly grounded), and the output transistor TFT1 and the compensation driving transistor TFT2 to which the OLED is coupled are coupled in a different way from those in FIG. 1.

In the above OLED pixel circuit, the photoresistor R1 detects the light emitted by the OLED. The photoresistor R1 has a certain resistance value. The photoresistor R1 is coupled in series to the voltage divider resistor R2 which has a certain resistance value, to generate a divided voltage VLDR to be applied to the gate electrode (i.e. the control electrode) of the compensation driving transistor TFT2. The OLED pixel circuit has the following operation principle:

when the OLED does not emit light, the VSCAN signal will turn off the corresponding pixel;

when the OLED emits light, the photoresistor R1 and the voltage divider resistor R2 are coupled in series to generate a divided voltage VLDR to cause the compensation driving transistor TFT2 to be operated in a linear region to supply a current to the OLED. At this time, when the brightness of the OLED becomes lower, the resistance value of R1 becomes smaller, the divided voltage VLDR increases, the driving current provided by the TFT2 increases, and the brightness of the OLED increases. When the brightness of the OLED becomes higher, the resistance value of R1 becomes larger, the divided voltage VLDR decreases, the current provided by TFT2 decreases, and the brightness of the OLED decreases. In this way, the compensation for the light-emitting brightness is achieved.

L denotes the brightness of the OLED, Rldr denotes the resistance value of R1, VLDR denotes the driving voltage of the compensation driving transistor TFT2, ITFT2 denotes the current of the compensation driving transistor, a downward arrow ↓ denotes decrease or becoming smaller, and an upward arrow ↑ denotes increase or becoming larger. Then, the operation principle of the OLED pixel circuit in FIGS. 1 and 2 may be represented as follows:

L↓→Rldr↓→VLDR↑→ITFT2↑→L↑;

L↑→Rldr↑→VLDR↓→ITFT2↓→L↓.

Second Embodiment

This embodiment provides an OLED pixel circuit, in which a driving unit including an N-type thin film transistor is compensated with a negative coefficient photoresistor. The specific circuit is shown in FIGS. 3 and 4.

In the OLED pixel circuit, both of the synchronous transistor S2 and the compensation driving transistor TFT2 are N-type thin film transistors. The photoresistor R1 is a negative coefficient photoresistor with a resistance value which decreases as the light-emitting brightness of the OLED increases. The free terminal of the series branch is one terminal of the photoresistor R1 which is not coupled to the voltage divider resistor R2. For the negative coefficient photoresistor R1, when there is no light irradiation, its resistance value presents a large value; and when there is light irradiation, its resistance value becomes smaller and decreases with the light irradiation increases.

Figure 3:
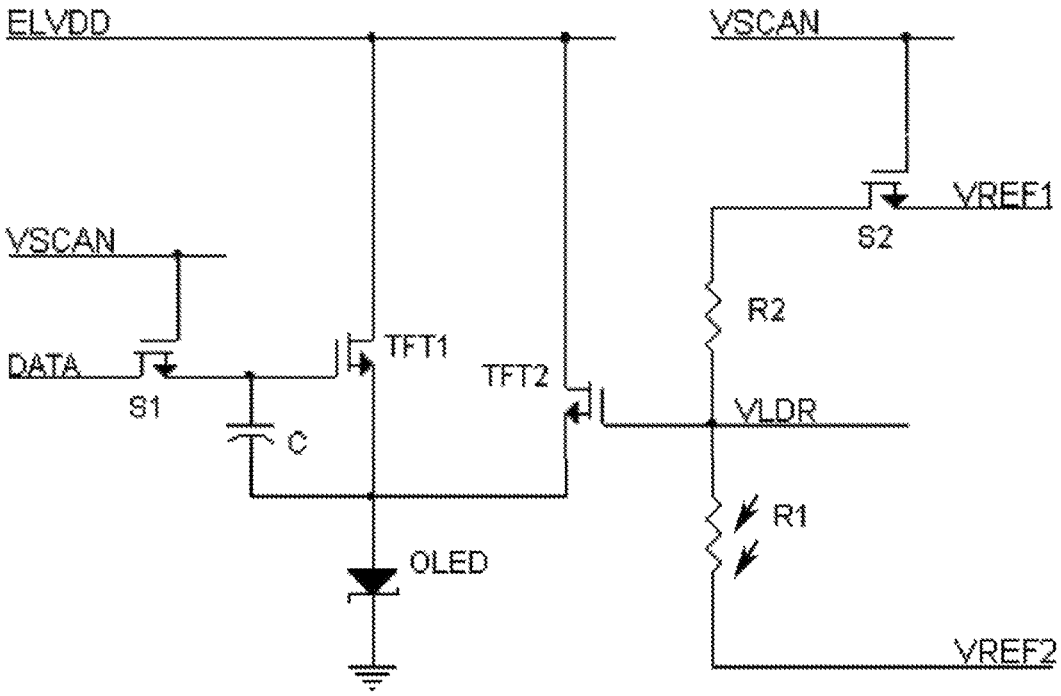
FIGS. 3 and 4 show principle views of an OLED pixel circuit according to a second embodiment of the present disclosure.

The OLED pixel circuit as shown in FIG. 3 uses an N-type thin film transistor, and the compensation unit uses the negative coefficient photoresistor R1 to detect the light emitted by the OLED. In the driving unit, the first electrode of the output transistor TFT1 is coupled to the first voltage input terminal. The second electrode of the output transistor TFT1 is coupled to the anode of the OLED and a second terminal of the storage capacitor C. The cathode of the OLED is grounded (that is, coupled to the second voltage input terminal). Here, the first electrode of the compensation driving transistor TFT2 is coupled to the first voltage input terminal, and the second electrode of the compensation driving transistor TFT2 is coupled to the second terminal of the storage capacitor C and the anode of the OLED.

Figure 4:
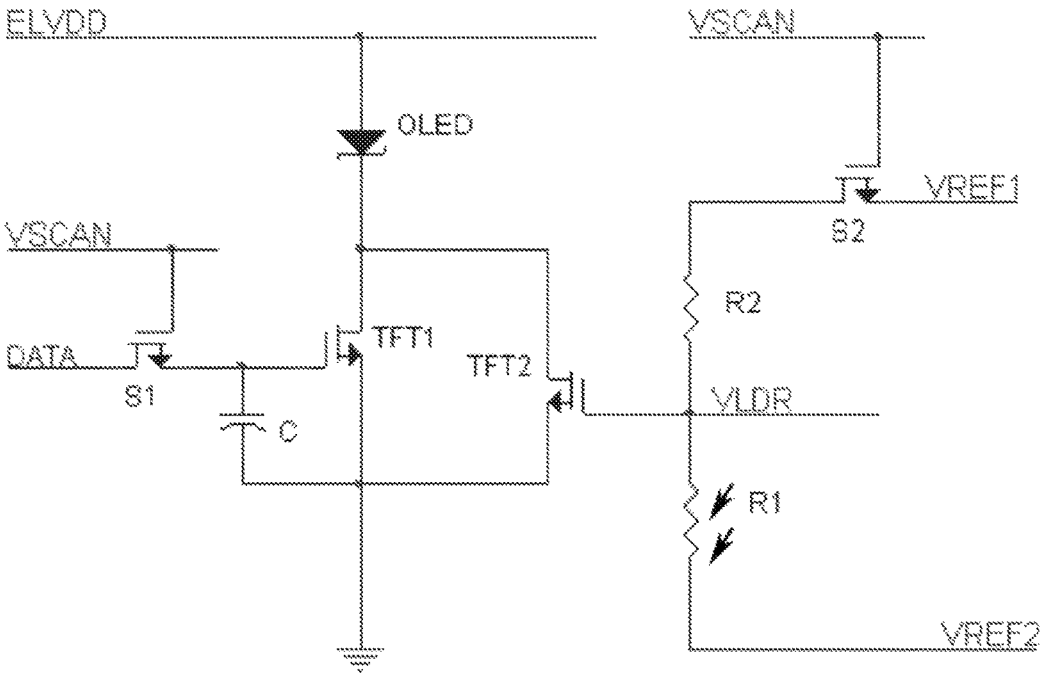

The OLED pixel circuit as shown in FIG. 4 uses an N-type thin film transistor, and the compensation unit uses the nagative coefficient photoresistor R1 to detect the light emitted by the OLED. In the driving unit, the first electrode of the output transistor TFT1 is coupled to the cathode of the OLED. The second electrode of the output transistor TFT1 is coupled to the second voltage input terminal and the second terminal of the storage capacitor C. The anode of the OLED is coupled to a high potential terminal (that is, the first voltage input terminal). Here, the first electrode of the compensation driving transistor TFT2 is coupled to the cathode of the OLED, and the second electrode of the compensation driving transistor TFT2 is coupled to the second terminal of the storage capacitor C and the second voltage input terminal.

The OLED pixel circuit in FIG. 4 has the same operation principle as the OLED pixel circuit in FIG. 3, except in that the electrodes of the OLED are coupled in a different way from that in FIG. 3 (in FIG. 3, the cathode of the OLED is grounded (that is, coupled to the second voltage input terminal), while in FIG. 4, the anode of the OLED is coupled to a high potential terminal and the cathode of the OLED is not directly grounded), and the output transistor TFT1 and the compensation driving transistor TFT2 to which the OLED is coupled are coupled in a different way from those in FIG. 3.

In the above OLED pixel circuit, the photoresistor R1 detects the light emitted by the OLED. The photoresistor R1 has a certain resistance value. The photoresistor R1 is coupled in series to the voltage divider resistor R2 which has a certain resistance value, to generate a divided voltage VLDR to be applied to the gate electrode (i.e. the control electrode) of the compensation driving transistor TFT2. The OLED pixel circuit has the following operation principle:

when the OLED does not emit light, the VSCAN signal will turn off the corresponding pixel;

when the OLED emits light, the photoresistor R1 and the voltage divider resistor R2 are coupled in series to generate a divided voltage VLDR to cause the compensation driving transistor TFT2 to be operated in a linear region to supply a current to the OLED. In this case, when the brightness of the OLED becomes lower, the resistance value of R1 becomes larger, the divided voltage VLDR increases, the driving current provided by TFT2 increases, and the brightness of the OLED increases. When the brightness of the OLED becomes higher, the resistance value of R1 becomes smaller, the divided voltage VLDR decreases, the driving current provided by TFT2 decreases, and the brightness of the OLED decreases. In this way, the compensation for the light-emitting brightness is achieved.

The operation principle of the OLED pixel circuit in FIGS. 3 and 4 may be represented as follows:

L↓→Rldr↑→VLDR↑→ITFT2↑→L↑;

L↑→Rldr↓→VLDR↓→ITFT2↓→L↓.

Third Embodiment

This embodiment provides an OLED pixel circuit, in which a driving unit including a P-type thin film transistor is compensated with a photoresistor of a positive coefficient. The specific circuit is shown in FIGS. 5 and 6.

In the OLED pixel circuit, both of the synchronous transistor S2 and the compensation driving transistor TFT2 are P-type thin film transistors. The photoresistor R1 is a positive coefficient photoresistor with a resistance value which increases as the light-emitting brightness of the OLED increases. The free terminal of the series branch is one terminal of the photoresistor R1 which is not coupled to the voltage divider resistor R2.

Figure 5:
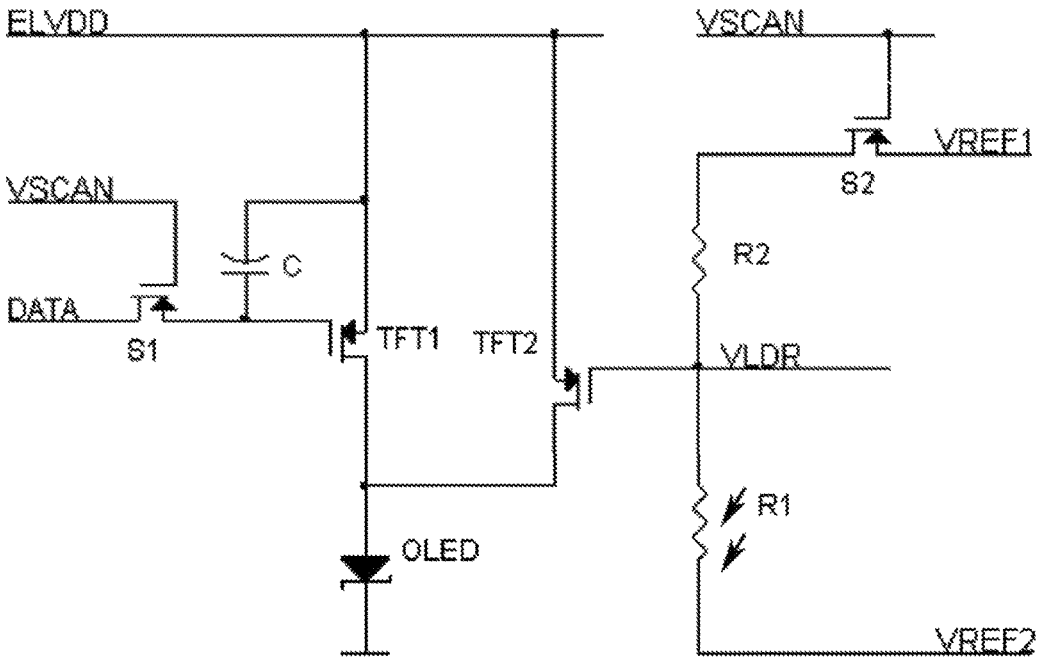
FIGS. 5 and 6 show principle views of an OLED pixel circuit according to a third embodiment of the present disclosure.

The OLED pixel circuit as shown in FIG. 5 uses a P-type thin film transistor, and the compensation unit uses the positive coefficient photoresistor R1 to detect the light emitted by the OLED. In the driving unit, the first electrode of the output transistor TFT1 is coupled to the first voltage input terminal and the second terminal of the storage capacitor C. The second electrode of the output transistor TFT1 is coupled to the anode of the OLED. The cathode of the OLED is grounded (that is, coupled to the second voltage input terminal). Here, the first electrode of the compensation driving transistor TFT2 is coupled to the first voltage input terminal, and the second electrode of the compensation driving transistor TFT2 is coupled to the anode of the OLED.

Figure 6:
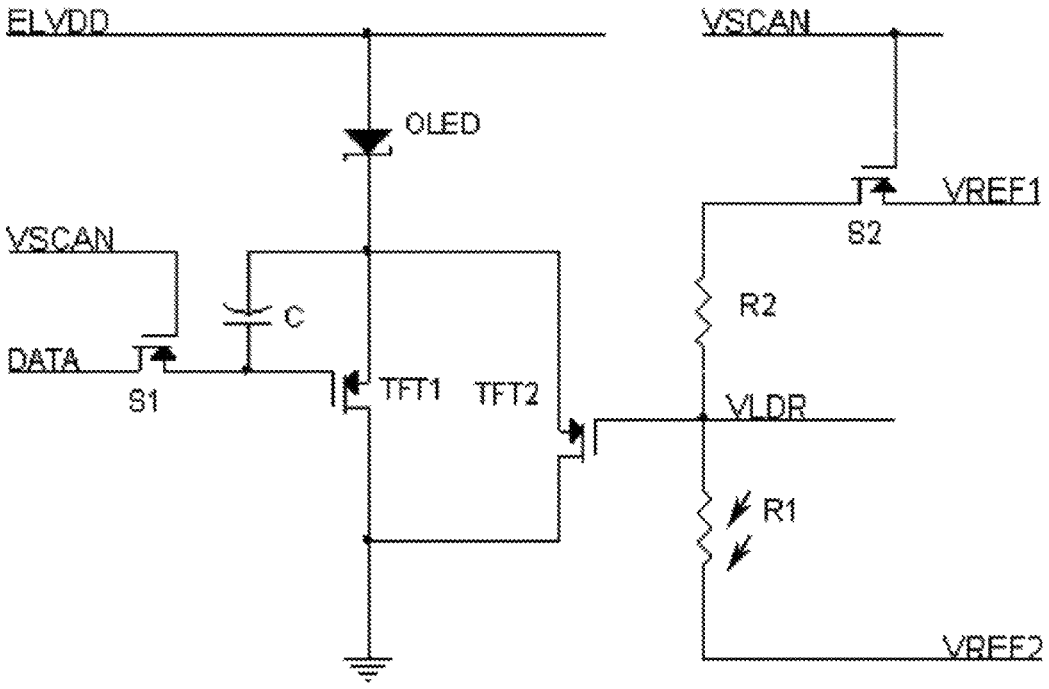

The OLED pixel circuit as shown in FIG. 6 uses a P-type thin film transistor, and the compensation unit uses the positive coefficient photoresistor R1 to detect the light emitted by the OLED. In the driving unit, the first electrode of the output transistor TFT1 is coupled to the cathode of the OLED and the second terminal of the storage capacitor C. The second electrode of the output transistor TFT1 is coupled to the second voltage input terminal. The anode of the OLED is coupled to a high potential terminal (that is, the first voltage input terminal). Here, the first electrode of the compensation driving transistor TFT2 is coupled to the cathode of the OLED, and the second electrode of the compensation driving transistor TFT2 is coupled to the second voltage input terminal.

The OLED pixel circuit in FIG. 5 has the same operation principle as the OLED pixel circuit in FIG. 6, except in that the electrodes of the OLED are coupled in a different way from that in FIG. 5 (in FIG. 5, the cathode of the OLED is grounded (that is, coupled to the second voltage input terminal), while in FIG. 6, the anode of the OLED is coupled to a high potential terminal and the cathode of the OLED is not directly grounded), and the output transistor TFT1 and the compensation driving transistor TFT2 to which the OLED is coupled are coupled in a different way from those in FIG. 5.

In the above OLED pixel circuit, the photoresistor R1 detects the light emitted by the OLED. The photoresistor R1 has a certain resistance value. The photoresistor R1 is coupled in series to the voltage divider resistor R2 which has a certain resistance value, to generate a divided voltage VLDR to be applied to the gate electrode (i.e. the control electrode) of the compensation driving transistor TFT2. The OLED pixel circuit has the following operation principle:

when the OLED does not emit light, the VSCAN signal will turn off the corresponding pixel;

when the OLED emits light, the photoresistor R1 and the voltage divider resistor R2 are coupled in series to generate a divided voltage VLDR to cause the compensation driving transistor TFT2 to be operated in a linear region to supply a current to the OLED. In this case, when the brightness of the OLED becomes lower, the resistance value of R1 becomes smaller, the divided voltage VLDR decreases, the driving current provided by TFT2 increases, and the brightness of the OLED increases. When the brightness of the OLED becomes higher, the resistance value of R1 becomes larger, the divided voltage VLDR increases, the driving current provided by TFT2 decreases, and the brightness of the OLED decreases. In this way, the compensation for the light-emitting brightness is achieved.

The operation principle of the OLED pixel circuit in FIGS. 5 and 6 may be represented as follows:

L↓→Rldr↓→VLDR↓→ITFT2↑→L↑;

L↑→Rldr↑→VLDR↑→ITFT2↓→L↓.

Fourth Embodiment

This embodiment provides an OLED pixel circuit, in which a driving unit including a P-type thin film transistor is compensated with a negative coefficient photoresistor. The specific circuit is shown in FIGS. 7 and 8.

In the OLED pixel circuit, both of the synchronous transistor S2 and the compensation driving transistor TFT2 are P-type thin film transistors. The photoresistor R1 is a negative coefficient photoresistor with a resistance value which decreases as the light-emitting brightness of the OLED increases. The free terminal of the series branch is one terminal of the voltage divider resistor R2 which is not coupled to the photoresistor R1.

Figure 7:
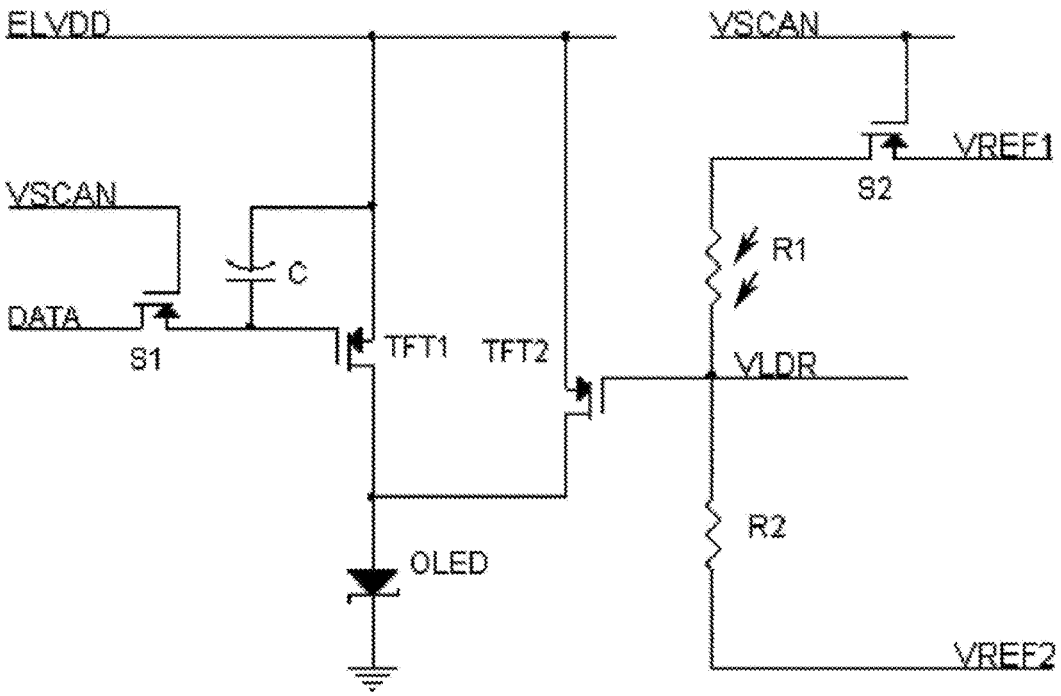
FIGS. 7 and 8 show principle views of an OLED pixel circuit according to a fourth embodiment of the present disclosure.

The OLED pixel circuit as shown in FIG. 7 uses a P-type thin film transistor, and the compensation unit uses the negative coefficient photoresistor R1 to detect the light emitted by the OLED. In the driving unit, the first electrode of the output transistor TFT1 is coupled to the first voltage input terminal and the second terminal of the storage capacitor C. The second electrode of the output transistor TFT1 is coupled to the anode of the OLED. The cathode of the OLED is grounded (that is, coupled to the second voltage input terminal). Here, the first electrode of the compensation driving transistor TFT2 is coupled to the first voltage input terminal, and the second electrode of the compensation driving transistor TFT2 is coupled to the anode of the OLED.

Figure 8:
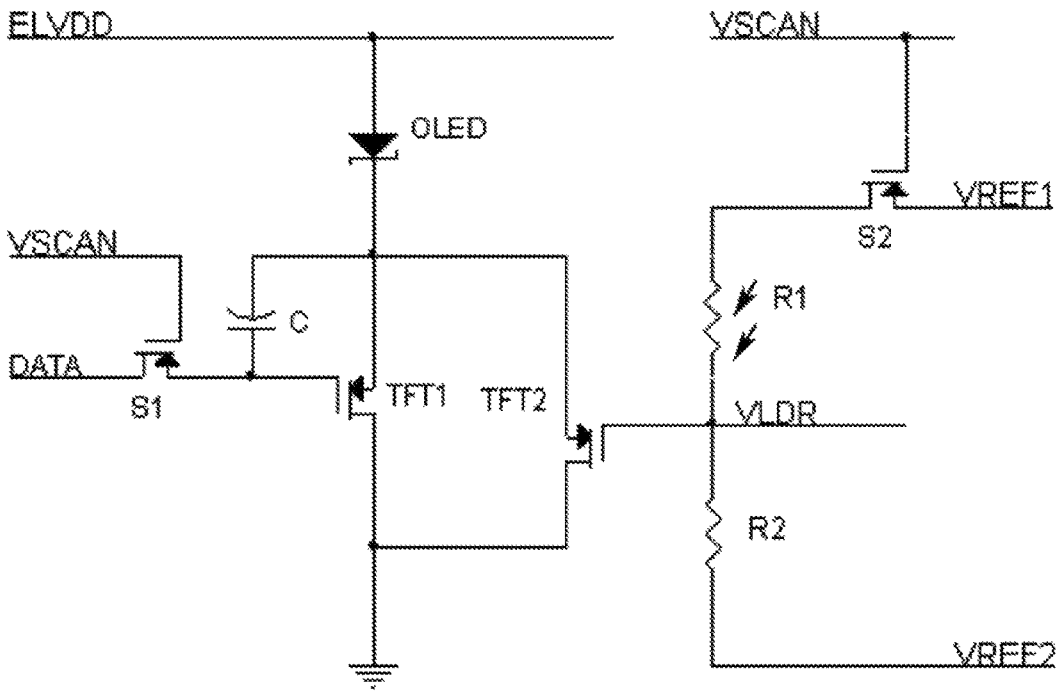

The OLED pixel circuit as shown in FIG. 8 uses a P-type thin film transistor, and the compensation unit uses the negative coefficient photoresistor R1 to detect the light emitted by the OLED. In the driving unit, the first electrode of the output transistor TFT1 is coupled to the cathode of the OLED and the second terminal of the storage capacitor C. The second electrode of the output transistor TFT1 is coupled to the second voltage input terminal. The anode of the OLED is coupled to a high potential terminal (that is, the first voltage input terminal). Here, the first electrode of the compensation driving transistor TFT2 is coupled to the cathode of the OLED, and the second electrode of the compensation driving transistor TFT2 is coupled to the second voltage input terminal.

The OLED pixel circuit in FIG. 8 has the same operation principle as the OLED pixel circuit in FIG. 7, except in that the electrodes of the OLED are coupled in a different way from that in FIG. 7 (in FIG. 7, the cathode of the OLED is grounded (that is, coupled to the second voltage input terminal), while in FIG. 8, the anode of the OLED is coupled to a high potential terminal and the cathode of the OLED is not directly grounded), and the output transistor TFT1 and the compensation driving transistor TFT2 to which the OLED is coupled are coupled in a different way from those in FIG. 7.

In the above OLED pixel circuit, the photoresistor R1 detects the light emitted by the OLED. The photoresistor R1 has a certain resistance value. The photoresistor R1 is coupled in series to the voltage divider resistor R2 which has a certain resistance value, to generate a divided voltage VLDR to be applied to the gate electrode (i.e. the control electrode) of the compensation driving transistor TFT2. The OLED pixel circuit has the following operation principle:

when the OLED does not emit light, the VSCAN signal will turn off the corresponding pixel;

when the OLED emits light, the photoresistor R1 and the voltage divider resistor R2 are coupled in series to generate a divided voltage VLDR to cause the compensation driving transistor TFT2 to be operated in a linear region to supply a current to the OLED. In this case, when the brightness of the OLED becomes lower, the resistance value of R1 becomes larger, the divided voltage VLDR decreases, the driving current provided by TFT2 increases, and the brightness of the OLED increases. When the brightness of the OLED becomes higher, the resistance value of R1 becomes smaller, the divided voltage VLDR increases, the driving current provided by TFT2 decreases, and the brightness of the OLED decreases. In this way, the compensation for the light-emitting brightness is achieved.

The operation principle of the OLED pixel circuit in FIGS. 7 and 8 may be represented as follows:

L↓→Rldr↑→VLDR↓→ITFT2↑→L↑;

L↑→Rldr↓→VLDR↑→ITFT2↓→L↓.

In the OLED pixel circuit of the first embodiment to the fourth embodiment, the change in the light-emitting brightness of the OLED is detected by the photoresistor. The change in the light-emitting brightness not only involves the factors of the change in the characteristics of the transistors in the driving unit, but also involves the factor of mismatch between the light-emitting brightness due to aging of the OLED device or difference of individual OLED devices and the current. Therefore, information on the light-emitting brightness of the OLED may be acquired directly to compensate the driving current of the OLED. It can be seen that, by the cooperation of the photoresistor and the compensation driving transistor, compensation for the unevenness of the light-emitting brightness of the display device caused by the factors such as parameter drift of the driving unit and aging of the OLED in the TFT-OLED pixel circuit can be achieved. This is a compensation method for unevenness of the light-emitting brightness of the display device of active-matrix organic light emitting diode (briefly referred to as AMOLED), which is simple in structure and very effective.

Fifth Embodiment

The present embodiment provides a display device, including the OLED pixel circuit provided by any one of the first embodiment to the fourth embodiment.

By utilizing the OLED pixel circuit provided by any one of the first embodiment to the fourth embodiment, the photoresistor may detect the light-emitting brightness of the organic light emitting diodes, and may, in turn, compensate for the unevenness of the light-emitting brightness of the display device.

The display device may be an electronic paper, an OLED panel, a mobile phone, a tablet computer, a TV, a monitor, a notebook computer, a digital photo frame, a navigator and any other products or parts having a display function.

The display device provided by the present embodiment emits even light, and has a better display effect.

It is to be understood that the above embodiments are merely illustrative embodiments for the purpose of illustrating the principles of the present disclosure, but the present disclosure is not limited thereto. It will be apparent to those skilled in the art that various changes and modifications can be made therein without departing from the spirit and essence of the present disclosure, which are also within the scope of the present disclosure.

What is claimed is:

1. An OLED pixel circuit, comprising an OLED and a driving unit for driving the OLED to emit light, wherein one electrode of the OLED is coupled to the driving unit, and a compensation unit, comprising a sensor, wherein the sensor is configured to sense light and convert an optical signal of the OLED into an electrical signal, wherein the compensation unit is configured to compensate a current of the driving unit for driving the OLED according to a light-emitting brightness of the OLED, wherein the sensor is a photoresistor, the compensation unit further comprises a synchronous transistor, a compensation driving transistor and a voltage divider resistor, wherein the photoresistor is coupled to the voltage divider resistor in series to form a series branch, a first terminal of the series branch is a constraint terminal and is coupled to the synchronous transistor, a second terminal of the series branch is a free terminal and coupled to a second reference voltage terminal;

a control electrode of the synchronous transistor is coupled to a scan signal terminal, a first electrode of the synchronous transistor is coupled to the constraint terminal of the series branch, and a second electrode of the synchronous transistor is coupled to a first reference voltage terminal;

a control electrode of the compensation driving transistor is coupled to a series coupling point of the photoresistor and the voltage divider resistor, a first electrode of the compensation driving transistor is coupled to a first voltage input terminal or a cathode of the OLED, a second electrode of the compensation driving transistor is coupled to an anode of the OLED or a second voltage input terminal; and a first reference voltage at the first reference voltage terminal is larger than a second reference voltage at the second reference voltage terminal, and the second reference voltage is smaller than a turn-on voltage of the OLED.

2. The OLED pixel circuit of claim 1, wherein the synchronous transistor and the compensation driving transistor are N-type thin film transistors, the photoresistor is a positive coefficient photoresistor with a resistance value which increases as the light-emitting brightness of the OLED increases, and the free terminal of the series branch is one terminal of the voltage divider resistor which is not coupled to the photoresistor.

3. The OLED pixel circuit of claim 1, wherein the synchronous transistor and the compensation driving transistor are N-type thin film transistors, the photoresistor is a negative coefficient photoresistor with a resistance value which decreases as the light-emitting brightness of the OLED increases, and the free terminal of the series branch is one terminal of the voltage divider resistor which is not coupled to the photoresistor.

4. The OLED pixel circuit of claim 1, wherein the synchronous transistor and the compensation driving transistor are P-type thin film transistors, the photoresistor is a positive coefficient photoresistor with a resistance value which increases as the light-emitting brightness of the OLED increases, and the free terminal of the series branch is one terminal of the voltage divider resistor which is not coupled to the photoresistor.

5. The OLED pixel circuit of claim 1, wherein the synchronous transistor and the compensation driving transistor are P-type thin film transistors, the photoresistor is a negative coefficient photoresistor with a resistance value which decreases as the light-emitting brightness of the OLED increases, and the free terminal of the series branch is one terminal of the voltage divider resistor, which is not coupled to the photoresistor.

6. The OLED pixel circuit of claim 1, wherein the voltage divider resistor is a constant resistor with respect to the photoresistor, and adjusts a divided voltage at the series coupling point in the series branch according to a ratio of the first reference voltage and the second reference voltage, such that the compensation driving transistor in the compensation unit is operated in a linear region.

7. The OLED pixel circuit of claim 1, wherein the driving unit comprises an output transistor, the driving unit is coupled to the first voltage input terminal and the second voltage input terminal, wherein one electrode of the OLED is coupled to the output transistor, and the other electrode of the OLED is coupled to the first voltage input terminal or the second voltage input terminal.

8. The OLED pixel circuit of claim 7, wherein the driving unit comprises a gating transistor and a storage capacitor, and is coupled to the scan signal terminal and a data signal terminal, wherein a control electrode of the gating transistor is coupled to the scan signal terminal, a first electrode of the gating transistor is coupled to the data signal terminal, a second electrode of the gating transistor is coupled to a control electrode of the output transistor;

a first electrode of the output transistor is coupled to the first voltage input terminal or the cathode of the OLED, a second electrode of the output transistor is coupled to the anode of the OLED or the second voltage input terminal; and a first terminal of the storage capacitor is coupled to the control electrode of the output transistor, the second terminal of the storage capacitor is coupled to the first electrode of the output transistor or the second electrode of the output transistor.

9. The OLED pixel circuit of claim 8, wherein the gating transistor and the output transistor are the same type of N-type thin film transistor or P-type thin film transistor as the synchronous transistor and the compensation driving transistor.

10. The OLED pixel circuit of claim 1, wherein the value of the second reference voltage at the second reference voltage terminal is equal to the value of the second input voltage at the second input voltage terminal.

11. The OLED pixel circuit of claim 1, wherein the first input voltage at the first input voltage terminal is a positive voltage, and the second input voltage at the second input voltage terminal is a ground voltage.

12. A display device, comprising an OLED pixel circuit, wherein the OLED pixel circuit comprises an OLED, a driving unit for driving the OLED to emit light, wherein one electrode of the OLED is coupled to the driving unit, and a compensation unit, comprising a sensor, wherein the sensor is configured to sense light and convert an optical signal of the OLED into an electrical signal, wherein the compensation unit is configured to compensate a current of the driving unit for driving the OLED according to a light-emitting brightness of the OLED, wherein the sensor is a photoresistor, the compensation unit further comprises a synchronous transistor, a compensation driving transistor and a voltage divider resistor, wherein the photoresistor is coupled to the voltage divider resistor in series to form a series branch, a first terminal of the series branch is a constraint terminal and is coupled to the synchronous transistor, a second terminal of the series branch is a free terminal and coupled to a second reference voltage terminal;

a control electrode of the synchronous transistor is coupled to a scan signal terminal, a first electrode of the synchronous transistor is coupled to the constraint terminal of the series branch, and a second electrode of the synchronous transistor is coupled to a first reference voltage terminal;

a control electrode of the compensation driving transistor is coupled to a series coupling point of the photoresistor and the voltage divider resistor, a first electrode of the compensation driving transistor is coupled to a first voltage input terminal or a cathode of the OLED, a second electrode of the compensation driving transistor is coupled to an anode of the OLED or a second voltage input terminal; and a first reference voltage at the first reference voltage terminal is larger than a second reference voltage at the second reference voltage terminal, and the second reference voltage is smaller than a turn-on voltage of the OLED.

13. The display device of claim 12, wherein the synchronous transistor and the compensation driving transistor are N-type thin film transistors, the photoresistor is a positive coefficient photoresistor with a resistance value which increases as the light-emitting brightness of the OLED increases, and the free terminal of the series branch is one terminal of the voltage divider resistor which is not coupled to the photoresistor.

14. The display device of claim 12, wherein the synchronous transistor and the compensation driving transistor are N-type thin film transistors, the photoresistor is a negative coefficient photoresistor with a resistance value which decreases as the light-emitting brightness of the OLED increases, and the free terminal of the series branch is one terminal of the voltage divider resistor which is not coupled to the photoresistor.

15. The display device of claim 12, wherein the synchronous transistor and the compensation driving transistor are P-type thin film transistors, the photoresistor is a positive coefficient photoresistor with a resistance value which increases as the light-emitting brightness of the OLED increases, and the free terminal of the series branch is one terminal of the voltage divider resistor which is not coupled to the photoresistor.

16. The display device of claim 12, wherein the synchronous transistor and the compensation driving transistor are P-type thin film transistors, the photoresistor is a negative coefficient photoresistor with a resistance value which decreases as the light-emitting brightness of the OLED increases, and the free terminal of the series branch is one terminal of the voltage divider resistor, which is not coupled to the photoresistor.

17. The display device of claim 12, wherein the voltage divider resistor is a constant resistor with respect to the photoresistor, and adjusts a divided voltage at the series coupling point in the series branch according to a ratio of the first reference voltage and the second reference voltage, such that the compensation driving transistor in the compensation unit is operated in a linear region.

18. The OLED pixel circuit of claim 12, wherein the value of the second reference voltage at the second reference voltage terminal is equal to the value of the second input voltage at the second input voltage terminal.

* * * * *